US005389746A

United States Patent [19]

Moody

[11] Patent Number: 5,389,746

[45] Date of Patent: Feb. 14, 1995

[54] SUBMARINE HULL STRUCTURES PROVIDING ACOUSTICALLY ISOLATED HULL OPENINGS

[75] Inventor: Paul E. Moody, Barrington, R.I.

[73] Assignee: The United States of America as represented by the Secretary of the Navy, Washington, D.C.

[21] Appl. No.: 268,598

[22] Filed: Jun. 30, 1994

[51] Int. Cl.[6] ..... G10K 11/00; B63H 1/15; B65D 53/00

[52] U.S. Cl. ..... 181/0.5; 440/52; 440/83; 440/112; 277/48; 277/DIG. 8; 277/DIG. 9; 114/312; 114/238; 114/337

[58] Field of Search ..... 440/52, 83, 112; 181/0.5, 198, 207; 277/48, DIG. 8, DIG. 9; 114/337, 20.1, 20.2, 312, 355, 238, 270, 173

[56] References Cited

U.S. PATENT DOCUMENTS

| | | | |
|---|---|---|---|
| 4,523,538 | 6/1985 | Hollmann et al. | 114/238 |
| 4,755,154 | 7/1988 | Ewbank | 440/52 |
| 4,884,985 | 12/1989 | Dyrkorn | 440/52 |
| 4,913,671 | 4/1990 | Gavriles et al. | 440/83 |
| 5,158,030 | 10/1992 | DuBois et al. | 114/20.1 |

*Primary Examiner*—J. Woodrow Eldred
*Attorney, Agent, or Firm*—Michael J. McGowan; Prithvi C. Lall; James M. Kasischke

[57] ABSTRACT

An acoustic isolation structure providing an acoustically isolated opening and comprising coaxial inner and outer annular structural members defining an irregular annulus between them. Acoustical isolation material is provided within this annulus to acoustically uncouple the two members. Radially overlapping structural rings extending from the members into the annulus limit lateral movement of the inner member and preserve the generally coaxial relation of the members.

16 Claims, 2 Drawing Sheets

SUBMARINE HULL STRUCTURES PROVIDING ACOUSTICALLY ISOLATED HULL OPENINGS

STATEMENT OF GOVERNMENT INTEREST

The invention described herein may be manufactured and used by or for the Government of the United States of America for governmental purposes without the payment of any royalties thereon or therefore.

BACKGROUND OF THE INVENTION (1) Field of the Invention

The present invention relates to new and improved submarine pressure hull structures which provide acoustically isolated hull openings. More particularly, the present invention relates to new and improved submarine hull structures having notable utility in providing acoustically isolated torpedo tube openings for launching torpedoes and the like and acoustically isolated shaft openings for supporting operating shafts and other rotary shafts which extend through the pressure hull.

(2) Description of the Prior Art

Torpedo tube openings are conventionally provided by two coaxial structural members, an outer tubular insert welded to the submarine pressure hull and an inner torpedo tube welded to the outer hull insert. Because of the rigid welded structure, noise and vibration generated by the torpedo ejection system are transmitted directly to the submarine hull.

Similarly, hull structures conventionally provided for supporting operating shafts and other rotary shafts which extend through the pressure hull transmit shaft generated vibrations and shaft transmitted noise directly to the submarine pressure hull via the shaft support structure including the usual shaft stuffing box.

Submarines are primarily detected by acoustic sensing systems which listen passively for any sound generated by the submarine, therefore reducing the transmission of vibrations and other noise to the submarine pressure hull is of critical importance in submarine design.

In prior art submarine systems, elastomeric materials are used around the launch tube structures to minimize propagatin of launch noise to the hull of the submarine. At great depths, pressure acting on the launch tubes can cause breakdown of the elastomeric damping materials. Resulting forces on the launch tube can cause the tube to be pushed through the hull insent. The same problems exist with shafts that pass through the submarine's pressure hull.

SUMMARY OF THE INVENTION

A principal object of the present invention is to provide a new and improved hull structure which provides an acoustically isolated hull opening.

Another object of the invention is to provide a new and improved torpedo tube opening that acoustically isolates the submarine pressure hull from the torpedo tube.

A further object of the invention is to provide a new and improved rotary shaft support structure that acoustically isolates the submarine pressure hull from the supported rotary shaft.

A further object of the invention is to provide a new and improved method of manufacturing a torpedo tube opening.

Other objects will be in part obvious and in part pointed out more in detail hereinafter.

Accordingly, the present invention relates to pressure hull structures which provide acoustically isolated hull openings. Each structure comprises two tubular structural members in coaxial radially spaced relationship. Axially spaced structural rings are provided on each tubular member along the annular cavity formed between the two tubular members. The annular cavity is filled with an elastomeric material to maintain the axial and coaxial relationship of the two tubular members. The elastomeric material serves as an intermediate sound deadening medium. The outer tubular member is thereby acoustically isolated from the inner tubular member to prevent the transmission of vibrations and noise from the inner tubular member to the outer tubular member and submarine pressure hull.

A torpedo tube opening incorporating the present invention comprises an inner torpedo tube and an outer coaxial tube welded to the submarine pressure hull. Each tube has a plurality of integral, axially spaced and radially extending structural rings within the annular cavity formed between the two coaxial tubes. The annular cavity is filled with an elastomeric material to acoustically isolate the outer tube and submarine pressure hull from the inner torpedo tube. The structural rings on the inner and outer tubes radially overlap to eliminate the need for fillet welds or other structural components which directly attach the torpedo tube to the outer tube.

A rotary shaft support structure incorporating the present invention comprises coaxial inner and outer coaxial structural members. The inner member is a flanged cylinder and comprises an inner structural tube and an integral peripheral flange or ring at one end of the inner tube. The other end of the inner tube is externally threaded for receiving an internally threaded retainer ring. The outer member provides a generally cylindrical cavity with a central, radially inwardly extending ring that is disposed between the end flange and retainer ring of the inner member. A shaft and hull stuffing box are coaxially received within the inner structural tube. An elastomeric material fills the irregular annular space between the two structural members. Noises generated by movement of the shaft or transmitted by the shaft are acoustically isolated from the submarine pressure hull by the acoustical dampening property of the intermediate elastomeric material.

A better understanding of the invention will be obtained from the following detailed description and the accompanying drawings of illustrative applications of the invention.

DETAILED DESCRIPTION OF THE PREFERRED EMBODIMENT

Figure 1:
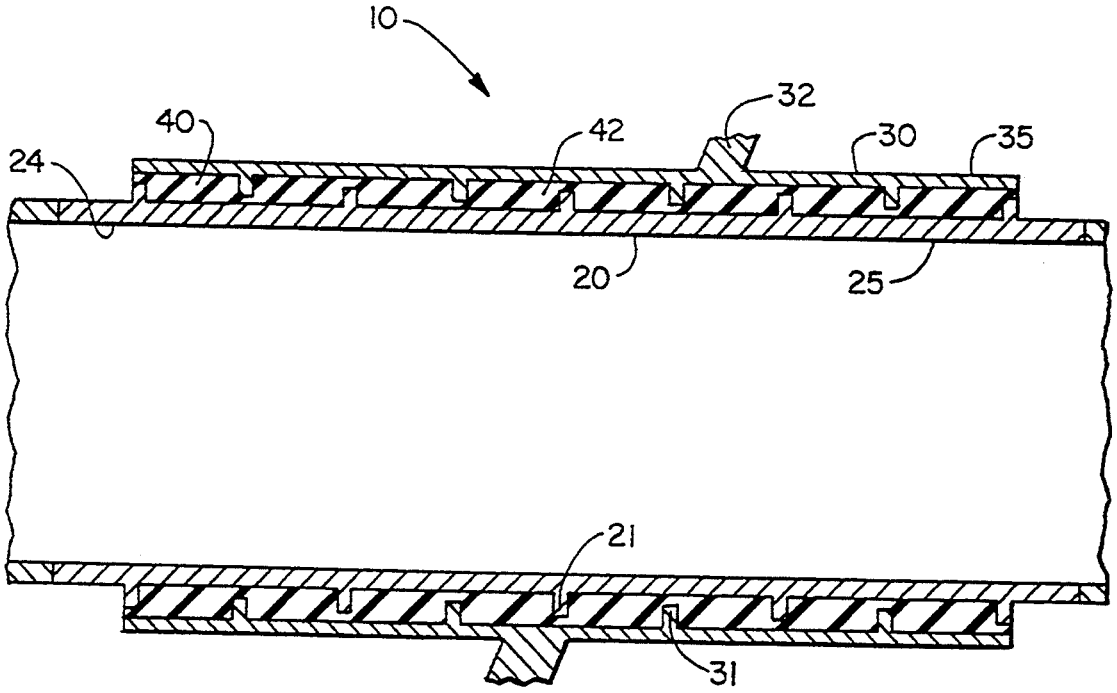
FIG. 1 is a section view, partly broken away and partly in section of a torpedo tube opening incorporating a first embodiment of the present invention.
Figure 2:
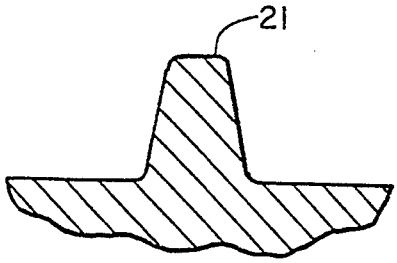
FIG. 2 is a partial axial section view, partly broken away and partly in section, of an inner annular structural member of the torpedo tube opening of FIG. 1.

In the drawings, like numerals represent like parts throughout the several figures. A first embodiment 10 of a submarine pressure hull structure incorporating the present invention is shown in FIGS. 1 and 2. The structure 10 comprises an inner structural member 20 having an inner cylindrical tube 25. An outer structural member 30 having an outer cylindrical tube 35 is disposed coaxially around the inner member 20. An inclined peripheral flange 32 is provided on the outer tube 35. The flange 32 forms part of the submarine pressure hull and is welded to the rest of the submarine hull (not shown). The flange 32 may be a separate plate welded to the outer tube 35 or may be formed integrally with the outer tube 35. The inner tube 25 provides a large diameter hull opening for launching torpedoes, missiles or other devices. The inner and outer members 20, 30 together form an intermediate axially extending annular cavity 42. Axially spaced structural rings 21 are provided on the inner tube 25 within the annular cavity 42. Axially spaced structural rings 31 are also provided on the outer tube 35 within the annular cavity 42. The structural rings 21, 31 alternate between the outer an inner tubes 25, 35. The alternating rings 21, 31 radially overlap. The annular cavity 42 is filled with an elastomeric material 40 to maintain the axial and radial relationship of the inner and outer tubes 25, 35. The overlapping rings 21, 31 in combination with the elastomeric filler material hold the inner torpedo tube against axial displacement within the outer support tube.

The structural rings 21, 31 and intermediate elastomeric filler material 40 provide sufficient mechanical strength to insure submarine pressure hull integrity. Shear stress calculations, using one inch thick structural rings 21, 31, indicate that the shear stress is less than in a conventional torpedo tube having less than one inch fillet welds between the torpedo tube and the outer coaxial tube. Each of the outer and inner rings 21, 31 may be tapered from the respective tube as shown in FIG. 2, radially outwardly or radially inwardly as the case may be, to the free end of the retaining ring. This taper eliminates stress concentration, facilitates filling the annular cavity 42 with elastomeric material 40 and reduces bending stresses.

In the torpedo tube opening embodiment, the outer and inner structural rings 31, 21 are isolated in the axial direction by a number of inches of elastomeric material 40. This thickness of acoustic isolation material is sufficient to be an effective isolator considering the low axial compression load which is dependent on the ship's design. In the radial direction, the metal parts are isolated by thick sections of elastomeric material 40 for most of the assembly's length and thinner sections of elastomeric material 40 for the remainder of the length. The isolation material is not under compression in the radial dimension. Therefore, this reduced thickness of elastomeric material 40 is considered sufficient for reducing the transmission of vibration from the inner structural member 20 to the outer structural member 30.

Figure 3:
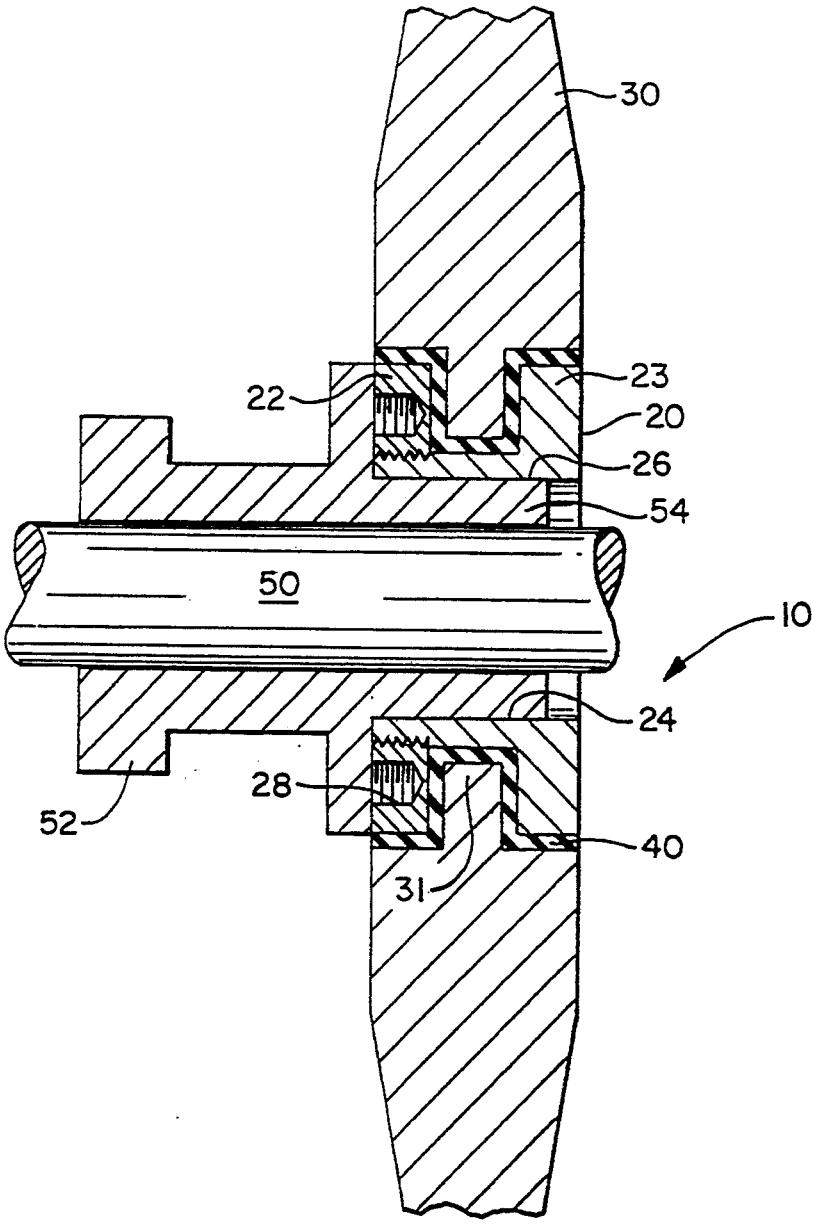
FIG. 3 is an axial section view, partly broken away and partly in section, of a rotary shaft and shaft support structure incorporating a second embodiment of the present invention.

A rotary shaft supporting structure incorporating a second embodiment of the present invention is shown in FIG. 3. In this embodiment, a single inner fixed structural ring 31 of an outer structural member 30 is disposed between an upper outer removable structural ring 22 and a lower outer fixed structural ring 23 portion of an inner structural member 20. An upper portion 26 of the inner structural member 20 is threaded for engagement with the removable structural ring 22. Acoustically isolating elastomeric material 40 is disposed between the outer structural member 30 and the inner structural member 20 and removable structural ring 22. The inner structural member 20 has a central bore 24 for coaxially receiving a shaft bearing 54 and a shaft 50. A shaft stuffing box 52 is provided on the shaft on the inside of the inner tube in a conventional manner. The removable structural ring 22 can have a plurality of threaded transverse bores 28 for mounting the hull stuffing box 52. Noise generated by the movement of the shaft 50 or transmitted through the shaft 50 is acoustically isolated from the outer structural member 30 and the submarine pressure hull by the elastomeric material 40.

The elastomeric material 40 is selected from those materials having the desired acoustic isolation properties, for example natural rubber, synthetic rubber or elastomeric plastic. The elastomeric material 40 acoustically uncouples the inner member 20 from the outer member 30.

Shear stress calculations for an operator shaft support structure in accordance with the present invention indicate that the shear stress is extremely low, allowing flexibility in use of the elastomeric material 40.

In the operator shaft support structure embodiment, the inner structure 20 and removable structural ring 22 are isolated from the outer structure 30 by a relatively small thickness of elastomeric material 40. This thickness is sufficient because the shaft 50 is not a significant transmission path for sound. The compression load on the elastomeric material 40 is minimal due to the designs significant compression area with respect to the area which is loaded by sea pressure.

A torpedo tube opening 10 can be constructed by manufacturing the inner and outer structural members 20, 30. The hull section 32 is welded to the outer structural member 30 if it is not integral to the member 30. The outer member 30 is then longitudinally split into at least two segments. Alternatively, the outer member 30 may be manufactured as a plurality of member segments. The outer member 30 segments are then positioned in radially spaced relationship around the inner member 20 in a positioning jig and welded together. The elastomeric material 40 is forced between the inner and outer members 20, 30, preferably by injection molding. The structure 10 is removed from the positioning jig and welded to the pressure hull of the ship via flange 32. Appropriate procedures and heat sinks are utilized to insure that the elastomeric material 40 is not effected when the assembly is welded to the pressure hull.

While preferred embodiments have been shown and described, various modifications and substitutions may be made thereto without departing from the spirit and scope of the invention. Accordingly, it is to be understood that the present invention has been described by way of illustration and not limitation.

What is claimed is:

1. A structure which provides an acoustically isolated opening, the structure comprising:

an inner, annular structural member having a coaxial opening providing said opening in said structure, said inner, structural member having at least one outer fixed, radially extending structural ring;

an outer, annular structural member surrounding said inner structural member in radially spaced relationship to form an axially extending annular cavity therebetween, said outer structural member having at least one inner fixed, radially extending structural ring, wherein said outer and inner structural rings radially overlap and are axially spaced along the annular cavity to form the said annular cavity with varying radial dimensions therealong; and acoustical isolating means disposed within said axially extending annular cavity supporting said inner member within said outer member in generally coaxial relationship with each other and acoustically isolating said outer annular structural member from said inner annular structural member.

2. The structure of claim 1 wherein said structural rings are radially tapered as they radially extend into said annular cavity.

3. The structure of claim 1 wherein said acoustical isolating means comprises an elastomeric material.

4. The structure of claim 3 wherein said elastomeric material is selected from the group consisting of natural rubber, synthetic rubber or elastomeric plastic.

5. The structure of claim 1 wherein said inner annular structural member has upper and lower outer radially extending structural rings and said outer annular structural member has a middle inner fixed radially extending structural ring disposed between said upper and lower structural rings.

6. The structure of claim 5 wherein said acoustical isolating means comprises an elastomeric material.

7. The structure of claim 6 wherein said elastomeric material is selected from the group consisting of natural rubber, synthetic rubber or elastomeric plastic.

8. The structure of claim 7 wherein said upper structural ring is threadably mounted on said inner structural member.

9. The structure of claim 1 wherein said inner annular structural member has a plurality of outer structural rings and said outer annular structural member has a plurality of inner structural rings, said inner and outer rings being positioned coaxially in an inter-leaved relationship on the surfaces of said outer and inner members.

10. The structure of claim 9 wherein said acoustical isolating means comprises an elastomeric material.

11. The structure of claim 10 wherein said elastomeric material is selected from the group consisting of natural rubber, synthetic rubber or elastomeric plastic.

12. The structure of claim 11 wherein said upper structural ring is threadably mounted on said inner structural member.

13. A shaft support structure for providing an acoustically isolated opening for an operating shaft comprising:

an inner annular structural member having a coaxial opening therein providing said acoustically isolated opening, said inner structural member having upper and lower outer radially extending structural rings;

an outer structural member surrounding said inner structural member in radially spaced relationship to form an axially extending annular cavity therebetween, said outer structural member having a middle inner fixed radially extending structural ring disposed between said inner structural member upper and lower structural rings, said inner structural member upper and lower structural rings radially overlapping said middle structural ring; and acoustical isolating means disposed within said axially extending annular cavity for supporting said inner member within said outer member in generally coaxial relationship to each other and for acoustically isolating said inner structural member from said outer structural member.

14. The structure of claim 13 wherein said upper structural ring is threadably mounted on said inner structural member.

15. The structure of claim 14 wherein said acoustical isolating means comprises an elastomeric material.

16. The structure of claim 15 wherein said elastomeric material is selected from the group consisting of natural rubber, synthetic rubber or elastomeric plastic.

* * * * *